US005158191A

United States Patent [19]

Douglas et al.

[11] Patent Number: 5,158,191

[45] Date of Patent: Oct. 27, 1992

[54] DUAL BOTTLE CONTAINER HAVING A DUAL OUTLET CAP

[75] Inventors: Jerry A. Douglas, Harrisburg, Ill.; Godfried Schmidt, Gardena, Calif.

[73] Assignee: Plastic Processing Corporation, Gardena, Calif.

[21] Appl. No.: 662,827

[22] Filed: Mar. 1, 1991

[51] Int. Cl.[5] ..... B65D 23/08; B65D 21/02; B65D 25/38

[52] U.S. Cl. ..... 215/10; 206/432; 206/504; 220/23.4; 220/23.83; 222/142.9; 222/143

[58] Field of Search ..... 206/432, 504; 215/6, 215/10; 220/23.4, 23.83; 222/142.3, 142.9, 143

[56] References Cited

U.S. PATENT DOCUMENTS

| | | | |
|---|---|---|---|
| 225,143 | 3/1880 | Kahler | 222/142.9 X |
| 1,568,160 | 1/1926 | Hibbert | 222/142.9 |
| 1,739,363 | 12/1929 | Kraft | 222/142.3 |
| 2,182,623 | 12/1939 | Dolar | 222/142.3 |
| 2,665,816 | 1/1954 | Anft | 220/524 |
| 2,754,962 | 7/1956 | Scrymgeour | 220/23.4 X |
| 2,890,816 | 6/1959 | Horland | 222/142.9 X |
| 3,194,426 | 7/1965 | Brown, Jr. | 220/23.4 |
| 3,269,389 | 8/1966 | Meurer et al. | 215/6 X |
| 3,326,358 | 6/1967 | Singleton | 215/6 X |
| 4,133,445 | 1/1979 | Mandelbaum | 206/504 X |
| 4,196,808 | 4/1980 | Pardo | 206/432 |
| 4,300,681 | 11/1981 | Klygis et al. | 206/432 X |
| 4,377,234 | 3/1983 | Kaplan | 206/432 |
| 4,416,373 | 11/1983 | de Larosiere | 206/432 |
| 4,509,639 | 4/1985 | Thompson | 220/23.4 X |

FOREIGN PATENT DOCUMENTS

| | | | |
|---|---|---|---|
| 366638 | 6/1923 | Fed. Rep. of Germany | 215/6 |
| 2115693 | 10/1972 | Fed. Rep. of Germany | 206/504 |
| 2365013 | 7/1975 | Fed. Rep. of Germany | 220/23.4 |
| 2713543 | 10/1978 | Fed. Rep. of Germany | 220/23.4 |
| 2552734 | 4/1985 | France | 215/10 |
| 444745 | 1/1949 | Italy | 215/6 |

*Primary Examiner*—Sue A. Weaver
*Attorney, Agent, or Firm*—Nilsson, Wurst & Green

[57] ABSTRACT

A dual container is disclosed having two bottles which are releasably interlocked together in side-by-side relation by a mortise and tenon. The bottles are held together to prevent undesired relative movement between the two bottles. A single cap covers both bottles. The cap has a separate outlet for each bottle which may be opened independently of each other.

3 Claims, 2 Drawing Sheets

DUAL BOTTLE CONTAINER HAVING A DUAL OUTLET CAP

BACKGROUND OF THE INVENTION

This invention relates to liquid containers, and, in particular, to a dual container which can store two different liquids and in which the contents of the bottles may be dispensed together or separately.

There are many products which are used together, such as shampoo and hair conditioner, ketchup and mustard, and oil and vinegar. These products are generally provided in two separate containers. Thus, the end-user must keep separate bottles together. For example, after shampooing, it may be difficult for a person in the shower to find a separate conditioner bottle. It is thus desirable to be able to store these related products together so that both may be readily available at the same time.

Dual containers, per se, have been shown in the past. U.S. Pat. No. 4,196,808, to Pardo, for example, shows a pair of containers which, as disclosed, may be bonded together or may be held together by shrink wrap. This provides for two containers which are either held together as a unit or are separate. The disadvantage in this is that if one container is emptied before the other, the emptied container cannot be readily replaced with a fresh container of the used product.

U.S. Pat. No. 3,194,426, to Brown, discloses a plurality of containers which are removably connected. The Brown containers use longitudinal dovetails to lock the containers together and a detent to prevent relative movement of the bottles along the axis of the connection. However, because longitudinal dovetails are used, the use of a detent to prevent relative movement of the containers is ineffectual. Further, because of the longitudinal dovetails oftentimes more force is required to join or separate the bottles than can be easily manually applied.

SUMMARY OF THE INVENTION

One object of this invention is to provide a dual container having a pair of interlocking bottles which may be readily interlocked and separated from one another without undue effort, but which are effectively interlocked.

Another object is to provide a single cover for both bottles.

Another object is to provide such a cap which will not interfere with independent opening of the bottles.

Other objects of this invention will be apparent to those skilled in the art in light of the following description and accompanying drawings.

In accordance with the invention, generally stated, there is provided a dual bottle container comprising a first bottle and a second bottle. Each of the bottles has a neck, means for releasably, transversely interlocking the bottles in side-by-side relationship so as to constitute a dual bottle container and for permitting said bottles to be readily separated, and means for holding the bottles in interlocked relation so that they will not transversely move relative to each other. The holding means may include a single cap for both of said bottles, a rib on one of the bottles and a groove on the other bottle which mate to prevent relative transverse movement of the bottles, or a label adhered to the dual bottle container across the interlocking means to prevent relative transverse movement of the bottles.

The interlocking means comprises a transverse mortise and tenon formed on adjacent sides of the first and second bottles. The mortise and tenon are formed to prevent relative longitudinal movement of said bottles. The mortise and tenon comprise a dove-tail-shaped mortise on one of said first and second bottles and a dove-tail shaped tenon on the other of said first and second bottles.

The single cap for both bottles includes a separate outlet for each said bottle and means for opening and closing the outlets independently of each other. The cap further includes a first cylinder depending from the top of said cap. The first cylinder is positioned so as to surround the neck of one of the bottles. A second cylinder depends from the top of the cap concentrically within the first cylinder. The first and second cylinders define a groove which receives the neck of one of the bottles. There is a set of such concentric cylinders for each of bottle neck. An opening above the second cylinder is provided to define an outlet for each bottle. The opening and closing means includes an arm which is hingedly connected to the cap with the arm carrying a pin positioned so as to be received in the opening to close the outlet.

Other objects and features of this invention will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
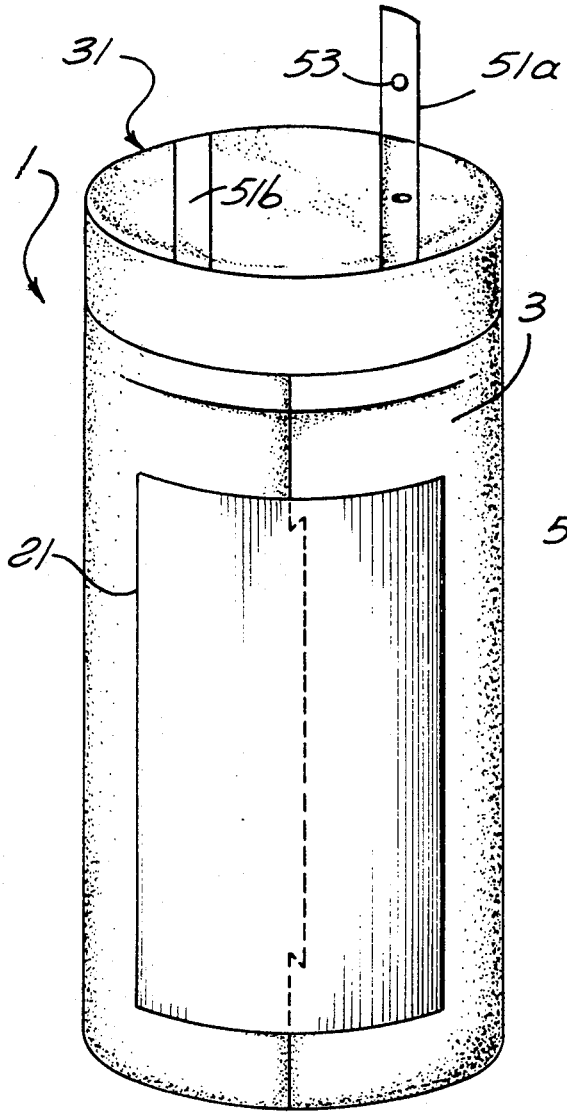
FIG. 1 is a perspective view of a dual bottle container of the present invention with a cap thereon and a label across the front thereof.
Figure 2:
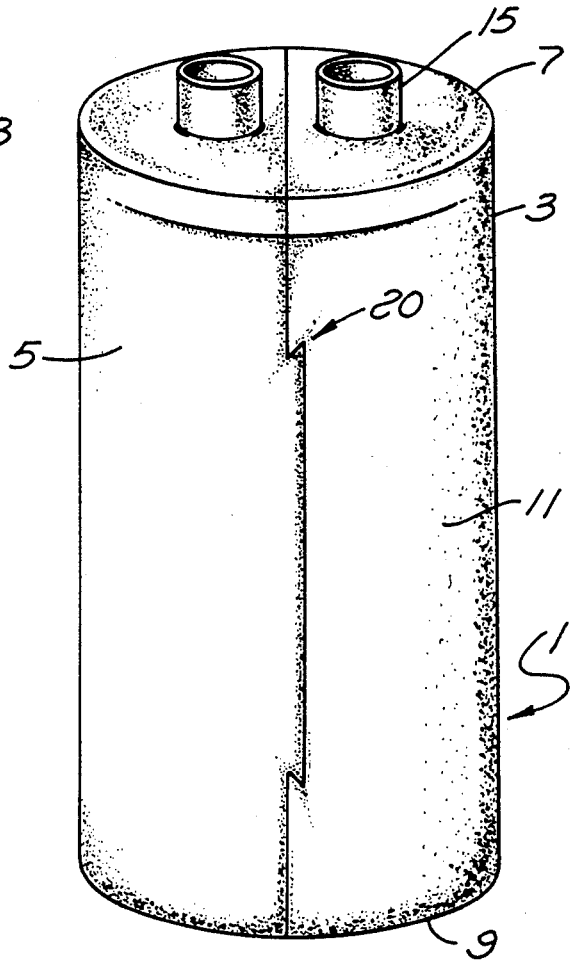
FIG. 2 is a perspective view of the dual bottle container without the cap and the label.
Figure 3:
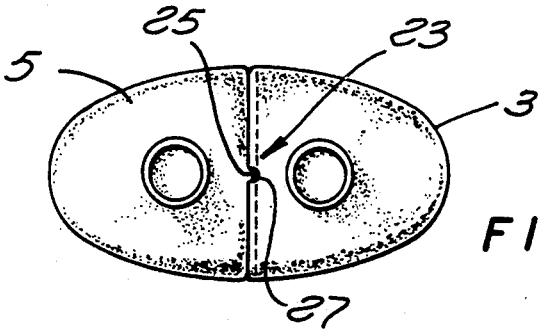
FIG. 3 is a top plan view of the dual container showing a detent for preventing relative lateral movement of the bottles from their interlocked position.
Figure 4:
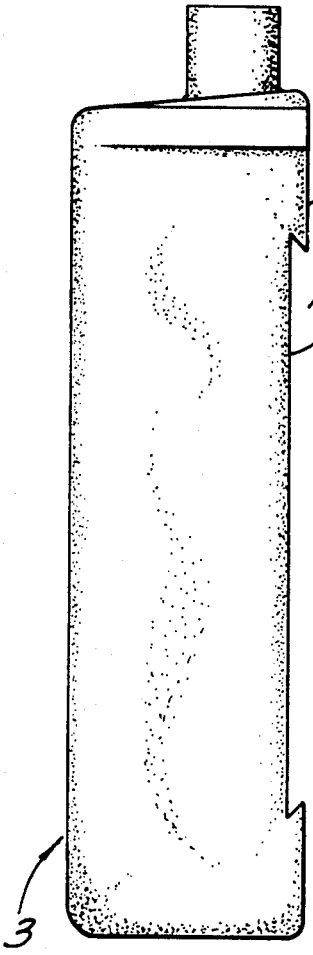
FIGS. 4 and 5 are front elevations of the two bottles separated from one another.
Figure 5:
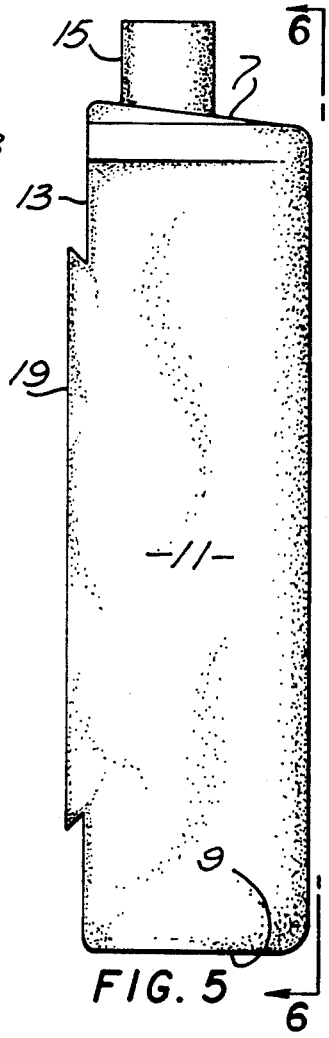
Figure 6:
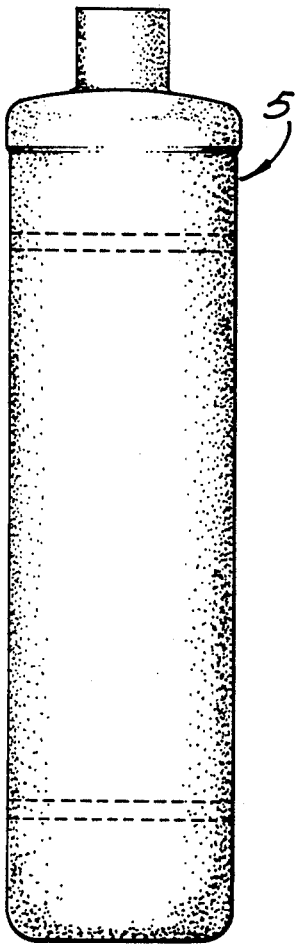
FIG. 6 is a side elevation of one of the bottles, the side elevation of the bottles being identical.

Referring now to the drawing and in particular to FIG. 1, reference numeral 1 represents a dual bottle container of the present invention. Container 1 includes two bottles 3 and 5 which are preferably made from a pliable, deformable synthetic resin material, such as polyethylene or other plastic. Each of the bottles 3 and 5 has a top wall 7, a bottom 9, an outside wall 11, and a generally planar side wall 13. A neck 15 protrudes up from bottle top wall 7. Side wall 13 of bottles 3 and 5 have a mortise 17 and a tenon 19, respectively, for transversely interlocking the bottles together in side-by-side relation, as shown in FIGS. 1 and 2. The mortise and tenon extend across (transversly) walls 13 to join the bottles together so that top walls 7, bottom walls 9 and sides 11 are substantially coplanar. Thus walls 13 are in face-to-face abutting relation.

Mortise 17 and tenon 19 extend transversely across walls 13 and are dovetailed so as to prevent relative vertical and side-to-side horizontal movement of bottles 3 and 5. The only relative movement of the bottles possible is motion in the direction of the dovetail.

The relative transverse motion of the bottles can be prevented by adhering a label 21 to both of the bottles so that it covers mortise 17 and tenon 19, as can be seen in FIG. 1. Thus, label 21, releasably holds bottles 3 and 5 together such that if the product in one bottle is used up before the product in the other, the label can be broken and the empty bottle can be replaced with a fresh bottle.

A detent 23 may also be used to prevent relative transverse movement of bottles 3 and 5. The detent 23 includes a semi-circular rib 25 which extends longitudinally along side 13 of bottle 5 and a groove 27 on side 13 of bottle 3. Rib 25 and groove 27 are positioned on their respective walls so that they will mate to provide for a smooth or uninterrupted outer-surface to container 1. Detent 23 facilitates the juncture of bottles 3 and 5 but does not require the application of undue manual force to result in their separation. Bottles 3 and 5 are preferably made of a resilient material, such as plastic (e.g., high density polyethylene), so that by exerting sufficient manual force, walls 13 will deform (if required) thus allowing rib 25 to slide out of groove 27 and thereby allowing separation of bottles 3 and 5.

In accordance with this invention, necks 15 of container 1 are closed by a unitary cover 31. Cover 31 includes openings 33 which define outlets for bottles 3 and 5, respectively. Openings 33 can be opened and closed independently of each other. Thus, cover 31 need not be removed from container 1. Accordingly, the cover provides another mechanism for preventing relative transverse motion of bottles 3 and 5.

Figure 7:
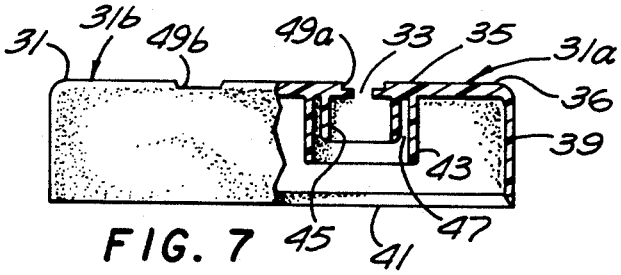
FIG. 7 is an elevational view of the cap, partially cut away.
Figure 9:
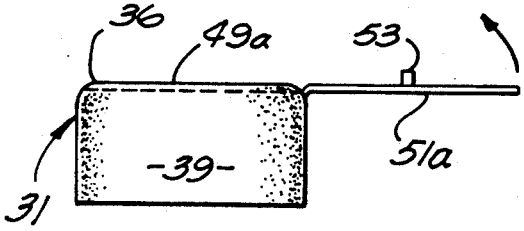
FIG. 9 is a side elevational view of the cap taken along line 9—9 of FIG. 8.
Figure 8:
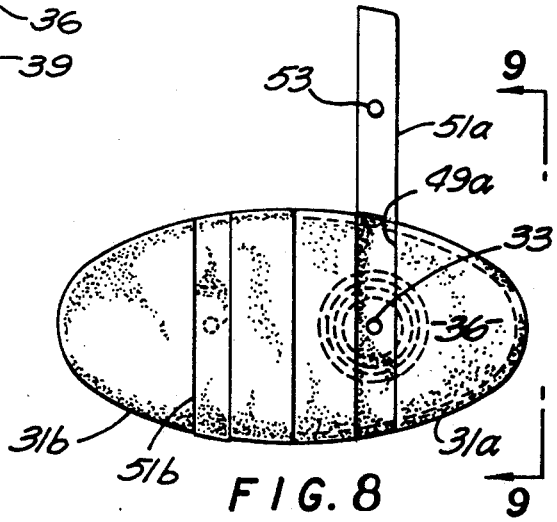
FIG. 8 is a top plan view of the cap showing a closure for an opening of the cap.

As shown FIGS. 7–9, cover 31 includes two identical halves 31*a* and 31*b*, only one of which will be described. Each cover half includes a top 35 having an exterior surface 36 and an interior surface 37, a side wall 39, and an open bottom 41. A first cylinder 43 depends from interior surface 37 of top 35. It is positioned such that it is concentric with and so it fits over the outside of neck 15 of bottle 3 or 5 when placed on container 1. A second cylinder 45 depends downwardly from top inner surface 37 concentrically within first cylinder 43. Second cylinder 45 is sized to be received within neck 15 when cover 31 is placed on container 1. Cylinders 43 and 45 define an annular groove 47 which receives neck 15. The fit of neck 15 in groove 47 is preferably snug so that cover 31 will not readily come off of container 1 as so that the neck is sealed relative to the cap.

Slots 49*a*, 49*b* are formed in top exterior surface 36. Each slot 49 extends across cover 31 from the front to the back thereof. Opening 33 is formed within each slot 49*a*, 49*b*. Arms 51*a*, 51*b* are hingedly connected to cap 31 so that they may be received in a respective slot 49*a*, 49*b*. Each arm 51*a*, 51*b* includes a pin 53 which is sized and positioned to sealably snap fit into a respective opening 33 when the arm is swung down into its slot 49*a*, 49*b* so as to close the bottle outlet. Each arm is preferably as long as its slot 49*a*, 49*b*, as can be seen in FIGS. 1 and 8.

The foregoing is set forth for illustrative purposes only. Numerous variations, within the scope of the appended claims, will be apparent to those skilled in the art in light of the foregoing description and accompanying drawings.

What is claimed is:

1. A dual container comprising:

a first bottle and a second bottle held in side-by-side relationship, each said bottle including a neck; and a single cap for both bottles, said cap including a separate outlet for each said bottle; means for opening and closing each said outlet independently of each other; a first cylinder depending from said top of said cap, said first cylinder being positioned so as to surround said neck of one of said first and second bottles; and a second cylinder depending from said top of said cap concentrically within said first cylinder; said first and second cylinders defining an annular groove which sealably receives said neck of one of said bottles, there being an identical set of said first and second cylinders for the other of said bottle necks.

2. The dual container of claim 1 wherein said cap includes a slot on the exterior of said cap top, said slot including an opening generally in register with a respective of said second cylinders therebelow, said opening defining said outlet.

3. The dual container of claim 2 wherein said opening and closing means includes an arm which is hingedly connected to said cap, said slot receiving said arm, said arm including a pin positioned so as to be received in said opening to close said outlet.

* * * * *